US005671578A

United States Patent [19]

Hohmann

[11] Patent Number: 5,671,578

[45] **Date of Patent: *Sep. 30, 1997**

[54] SURFACE-MOUNTED VENEER ANCHOR FOR SEISMIC CONSTRUCTION SYSTEM

[75] Inventor: Ronald Peter Hohmann, Syosset, N.Y.

[73] Assignee: Hohmann & Barnard, Inc., Happauge, N.Y.

[ * ] Notice: The term of this patent shall not extend beyond the expiration date of Pat. No. 4,875,319.

[21] Appl. No.: 427,199

[22] Filed: Apr. 24, 1995

[51] Int. Cl.[6] ..... E04B 1/02

[52] U.S. Cl. ..... 52/562; 52/713

[58] Field of Search ..... 52/379, 479, 562, 52/564, 712, 714, 383, 508, 713, 434, 410

[56] References Cited

U.S. PATENT DOCUMENTS

| | | | |
|---|---|---|---|
| 4,021,990 | 5/1977 | Schwalberg | 52/479 |
| 4,373,314 | 2/1983 | Allan | 52/434 |
| 4,598,518 | 7/1986 | Hohmann | 52/410 |
| 4,875,319 | 10/1989 | Hohmann | 52/383 |
| 5,408,798 | 4/1995 | Hohmann | 52/562 |

*Primary Examiner*—Carl D. Friedman
*Assistant Examiner*—David Jersen
*Attorney, Agent, or Firm*—Siegmar Silber

[57] ABSTRACT

A seismic construction system is disclosed that includes a surface-mounted veneer anchor, a box tie member, and a facing anchor. The primary components of the veneer anchor is a wire formative providing closed loop, wire-to-wire connections between the formative and the box tie device. The veneer anchor has a baseplate with a wire formative attached thereto having elongated eye wire extensions. Each pair of eye wires accommodates the threading thereonto of a box tie through the open end of the box tie. The box tie is then positioned so that the open end is secured to the facing anchor and is embedded together with the facing anchor into the bed joint thereof. The facing anchor includes a seismic clip for accommodating a straight wire run and receiving the open end of the box tie. The facing anchor is embedded in a bed joint of the facing. As the elongated eye wires have sealed eyelets or loops and the open ends of the box ties are sealed in the joints of the exterior wythes, a positive, closed-loop interengagement results. In insulated structures, the elongated eye portions is oriented to secure the insulating panels and the insulation are protected by insulation shields.

20 Claims, 5 Drawing Sheets

SURFACE-MOUNTED VENEER ANCHOR FOR SEISMIC CONSTRUCTION SYSTEM

CROSS-REFERENCES TO RELATED APPLICATIONS

This application is related to the following applications: U.S. patent application Ser. No. 08/145,583 entitled Seismic Construction System for Insulated Wall System; U.S. patent application Ser. No. 08/145,584, entitled Veneer Anchoring System; and, U.S. patent application Ser. No. 08/145,585, entitled Seismic Construction System, all filed concurrently on Nov. 4, 1993.

BACKGROUND OF THE INVENTION

1. Field of the Invention

This invention relates to an improved surface-mounted veneer anchor for use in conjunction with a seismic construction system having an inner wythe and an outer wythe. More particularly, the invention relates to construction accessory devices for surface mounting veneer anchors and for embedding a continuous wire in the bed joints of the outer wythe. These accessory devices include captive wire formatives with positive interlocking arrangements. The invention is applicable to seismic structures having an outer wythe of brick facing in combination with an inner wythe of masonry block or dry wall construction and with various forms of insulation.

2. Description of the Prior Art

In the past, investigations relating to the effects of various forces, particularly lateral forces, upon brick veneer masonry construction demonstrated the advantages of having a continuous wire embedded in the mortar joint of anchored veneer walls. The seismic aspect of these investigations were referenced in the inventor's prior patent, namely U.S. Pat. No. 4,875,319. Besides earthquake protection, the failure of several high-rise buildings to withstand wind and other lateral forces has resulted in the incorporation of a requirement for continuous wire reinforcement in the Uniform Building Code provisions. The inventor's related Seismiclip® and DW-10-X® products (manufactured by Hohmann & Barnard, Inc., Hauppauge, N.Y. 11788) have become widely accepted in the industry. The use of a continuous wire in masonry veneer walls has also been found to provide protection against problems arising from thermal expansion and contraction and improving the uniformity of the distribution of lateral forces in a structure.

The following patents are believed to be relevant and are disclosed as being known to the inventor hereof:

| Patent | Inventor | Issue Date |
|---|---|---|
| 3,377,764 | Storch | 04/16/1968 |
| 4,021,990 | Schwalberg | 05/10/1977 |
| 4,373,314 | Allan | 02/15/1983 |
| 4,473,984 | Lopez | 10/02/1984 |
| 4,598,518 | Hohmann | 07/08/1986 |
| 4,869,038 | Catani | 09/26/1989 |
| 4,875,319 | Hohmann | 10/24/1989 |

It is noted that these devices are generally descriptive of wire-to-wire anchors and wall ties and have various cooperative functional relationships with straight wire runs embedded in the interior and/or exterior wythe. Several of the prior art items are of the pintle and eyelet/loop variety without positive restriction against escape upon vertical displacement.

U.S. Pat. No. 3,377,764—D. Storch—Issued Apr. 16, 1968

Discloses a bent wire, tie-type anchor for embedment in a facing exterior wythe engaging with a loop attached to a straight wire run in a backup interior wythe.

U.S. Pat No. 4,021,990—B. J. Schwalberg—Issued May 10, 1977

Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—J. A. Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518—R. Hohmann—Issued Jul. 7 1986

Discloses a dry wall construction system with wallboard attached to the face of studs which, in turn, are attached to an inner masonry wythe. Insulation is disposed between the webs of adjacent studs.

U.S. Pat. No. 4,869,038—M. J. Catani—Issued Sep. 26, 1989

Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319—R. Hohmann—Issued Oct. 24, 1989

Discloses a seismic construction system for anchoring a facing veneer to wallboard/metal stud construction with a pronged sheetmetal anchor. Wall tie is distinguished over that of Schwalberg '990 and is clipped onto a straight wire run.

None of the above provide a completely interlocked arrangement between the inner wythe and the outer wythe, such as a brick veneer, and all of the above lack a fixed interconnection as described hereinbelow.

SUMMARY

In general terms, the invention disclosed hereby is a seismic construction system that includes a surface-mounted veneer anchor. The seismic construction system hereof is applicable to construction of a wall having an inner wythe which can either be of dry wall construction or masonry block and an outer wythe and to insulated and non-insulated structures. The wythes are in a spaced apart relationship and form a cavity therebetween. In the disclosed system, a unique combination of a veneer anchor (attachable to either masonry or metal studs), a box tie member, and a facing anchor is provided. The invention contemplates that the primary components of the veneer anchor are wire formatives providing closed loop, wire-to-wire connections therebetween.

In the first embodiment of this invention, the inner wythe is constructed from a masonry block material, the masonry anchor has a baseplate with a wire formative attached thereto having elongated eye wire extensions. The elongated eye wires extend into the cavity between the wythes. Each pair of eye wires accommodates the threading thereonto of a box tie through the open end of the box tie. The box tie is then positioned so that the open end is secured to the facing anchor and is embedded together with the facing anchor into the bed joint thereof. The baseplate of the veneer anchor is surface-mounted onto the masonry block of the interior wythe. The facing anchor includes a seismic clip for accommodating a straight wire run and receiving the open end of the box tie. The facing anchor is embedded in a bed joint of the exterior wythe. As the elongated eye wires have sealed eyelets or loops and the open ends of the box ties are sealed in the joints of the exterior wythes, a positive, closed-loop interengagement results.

In another mode of practicing this invention, the inner wythe is a dry wall construct, the dry-wall anchor, having a stamped metal baseplate, is attached by sheetmetal screws to the metal vertical channel members of the wall. Each dry-wall anchor accommodates in rolled flanges of the baseplate a wire formative having a pair of elongated eye wires. As in the case of the masonry inner wythe, the open end of the box tie is then positioned so that the open end is securable to a seismic clip that is part of the facing anchor. The facing anchor also accommodates one or more straight wire runs The facing anchor is embedded in a joint of the exterior wythe. Because the elongated eyes of the dry-wall anchor are closed loop and the open ends of the box ties are sealed in the joints of the exterior wythes, a positive interengagement results.

In the above, when the technology is applied to insulated structures, the elongated eye portions can be oriented to secure the insulating panels and the insulation can be protected by insulation shields as described hereinbelow.

OBJECT AND FEATURES OF THE INVENTION

It is an object of the present invention to provide in a seismic construction having a facing wythe and a backup wythe, a surface-mounted veneer anchor, a box tie device, and a seismic facing anchor including continuous wire reinforcement in the mortar joint of the facing wythe.

It is another object of the present invention to provide labor-saving devices to aid in seismic-type installations of brick and stone veneer and the securement thereof to an inner wythe.

It is yet another object of the present invention to provide a veneer anchor system which ties together the continuous wire reinforcement in a positive manner such that the connective portion in the cavity between the wythes cannot separate.

It is a further object of the present invention to provide a veneer anchor system comprising a limited number of component parts that are economical of manufacture resulting in a relatively low unit cost.

It is yet another object of the present invention to provide a veneer anchor system which restricts lateral and horizontal movements of the facing wythe with respect to the inner wythe, but is adjustable vertically.

It is a feature of the present invention that the box tie, after being threadedly inserted into a veneer anchor has the open end thereof, embedded in a bed joint of the facing wythe together with the facing anchor.

It is another feature of the present invention that the box tie is utilizable with an elongated eye wire for either a masonry block having aligned or unaligned bed joints or for a dry wall construct that secures to a metal studs.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
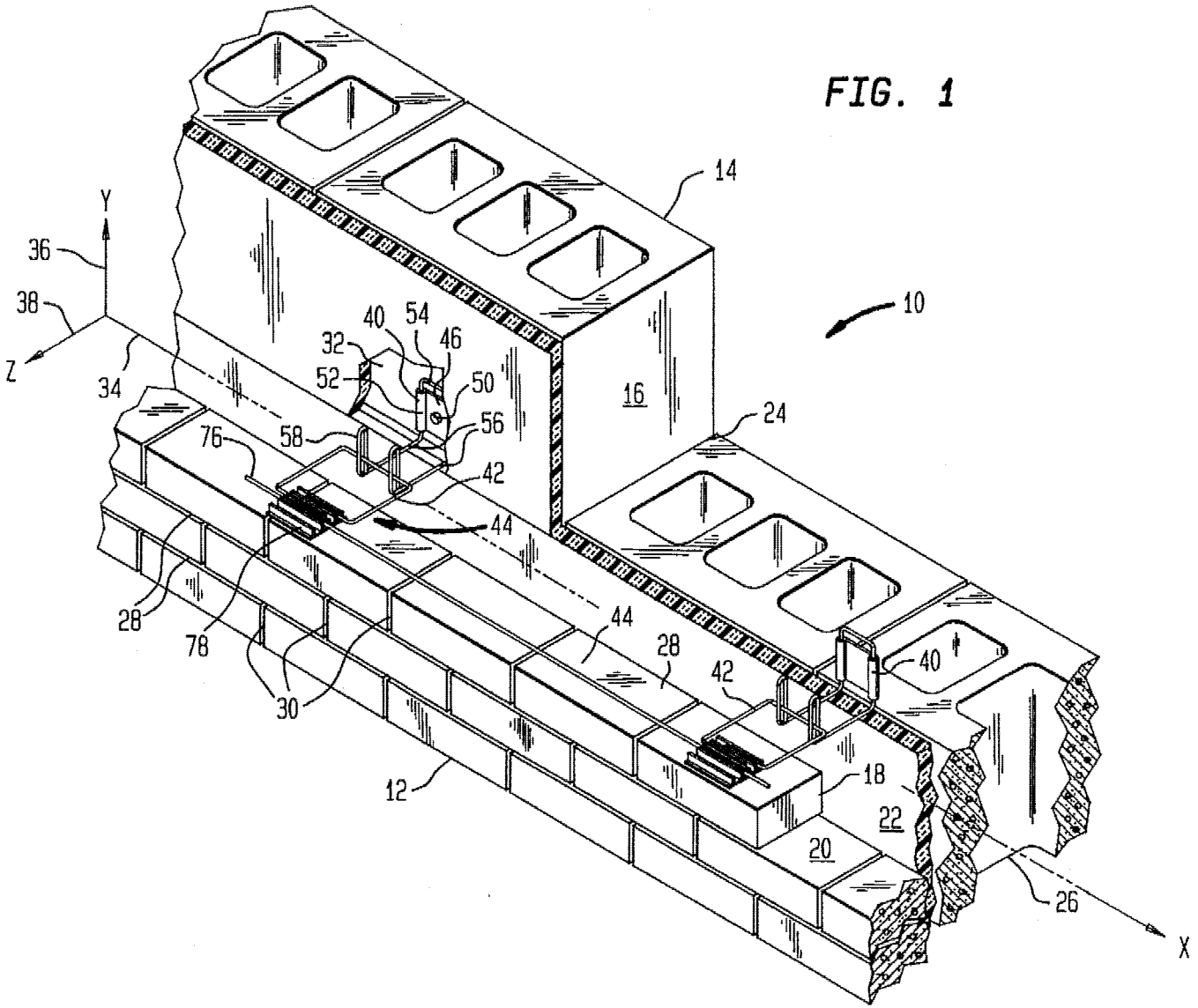
FIG. 1 is a perspective view of a first embodiment of a seismic construction system, including a surface-mounted veneer anchor, and shows a wall with an inner wythe of masonry block and an outer wythe of brick veneer having the bed joints thereof out of alignment with the veneer anchor.
Figure 2:
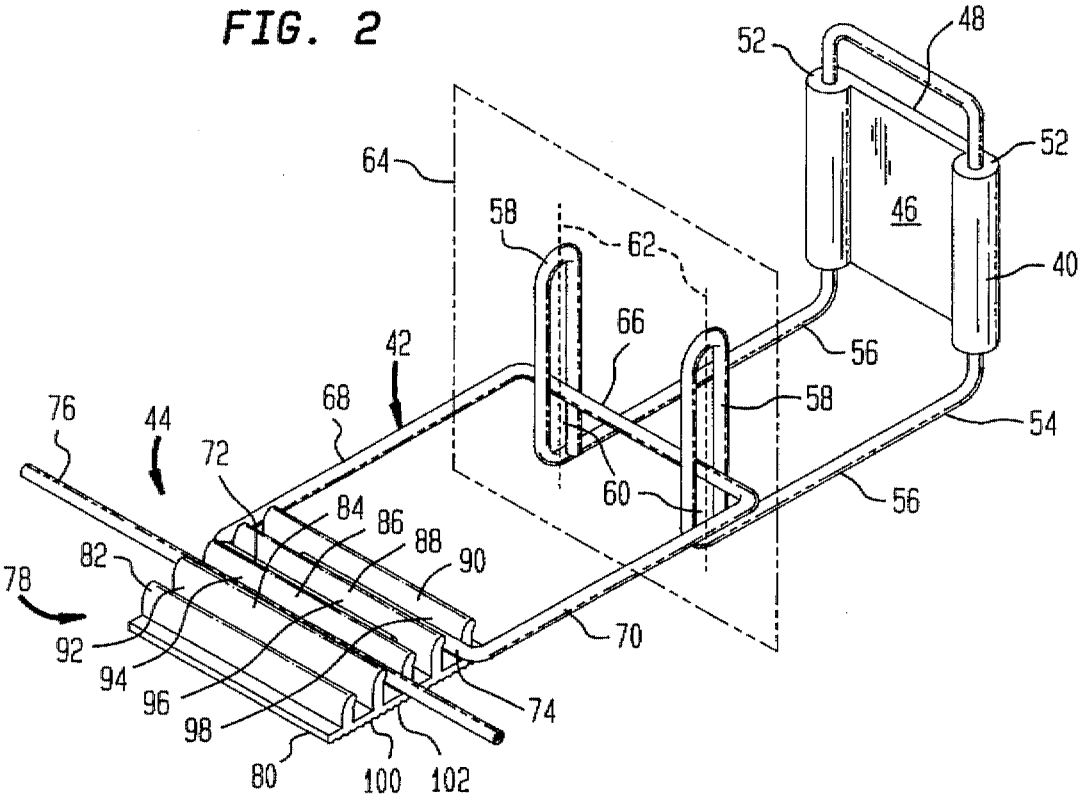
FIG. 2 is a partial perspective view of FIG. 1 showing details of the veneer anchor, the box tie, the seismic clip, and the reinforcement wire.
Figure 3:
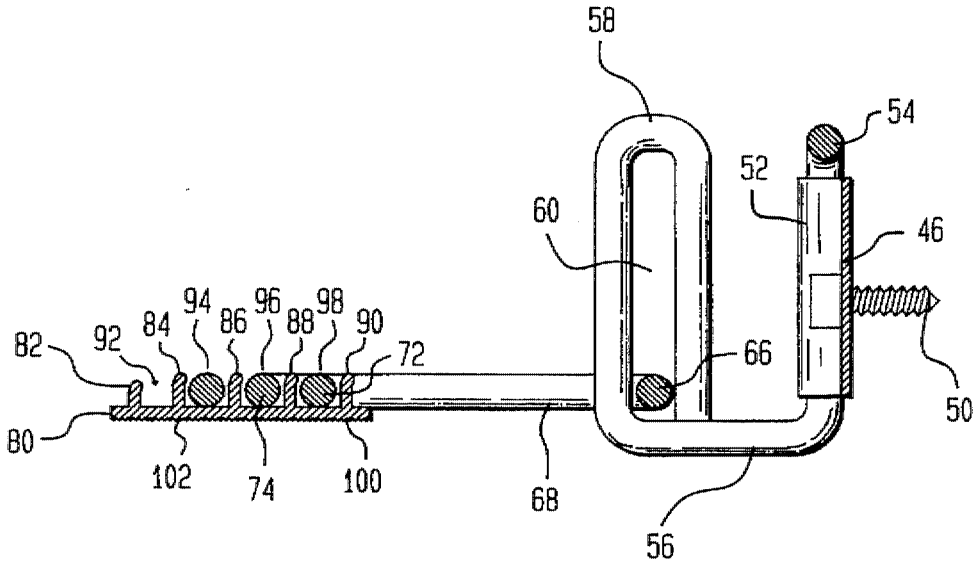
FIG. 3 is a cross-sectional view of the box tie and facing anchor of FIG. 2.

Referring now to FIGS. 1 to 3, the first embodiment of a seismic construction system of this invention is shown and is referred to generally by the numeral 10. In this embodiment, a wall structure 12 is shown having an interior wythe 14 of masonry blocks 16 and an exterior wythe 18 of facing brick 20. Between the interior wythe 14 and the exterior wythe 18, a cavity 22 is formed. In the first embodiment, successive bed joints 24 and 26 are formed between courses of blocks 16 and the joints are substantially planar and horizontally disposed. Also, successive bed joints 28 and 30 are formed between courses of bricks 20 and the joints are substantially planar and horizontally disposed. For purposes of discussion, the exterior surface 32 of the interior wythe 14 contains a horizontal line or x-axis 34 and an intersecting vertical line or y-axis 36. A horizontal line or z-axis 38 also passes through the coordinate origin formed by the intersecting x-and y-axes. Further, it will be seen that the various anchor structures are constructed to restrict movement interfacially—wythe vs. wythe—along the z-axis and, in this embodiment, along the y-axis. The system 10 includes a veneer anchor 40 constructed for affixation to masonry blocks 16 and a box tie device 42 that is constructed to interlock with a facing anchor 44, both of which are for embedment in bed joint 28. The veneer anchor 40 is shown in FIG. 1 as being affixed to a course of blocks 16. In the best mode of practicing the invention, a sheetmetal plate or baseplate 46 is formed having a rear surface 48 which, when the baseplate 46 is mounted on the masonry block 16 by an attachment device 50, such as explosiveemplaced fastening device, is coplanar with the exterior surface 32 of masonry blocks 16. Although any of a number of methods may be used to attach the baseplate and the wire formative portion of this surface-mounted veneer anchor, the baseplate 46 hereof is constructed with flanges 52 extending forwardly (when viewed as installed) from at least two sides thereof and being dimensioned to accommodate a wire formative 54 therewithin. A spaced pair of transverse wire member portions 56 are constructed to extend therefrom. These pairs of wire member portions 56 extend into the cavity 22. As will become clear by the description which follows, the spacing therebetween wire member portions 156 limits the x-axis movement of the construct. Each transverse wire member portion 56 has at the end opposite the attachment end an elongated eye wire portion 58 formed continuous therewith. Upon installation, the eye 60 of eye wire portion 58 is constructed to be within a substantially vertical plane (a yz plane) normal to exterior surface 32 and the longitudinal axes 62 of eyes 60 to be within a substantially vertical plane 64 (an xy plane) parallel to exterior surface 32. The spatial relationship between the pair of elongated eyes 60 is constructed so that a box tie device 42 is threadedly emplaceable thereinto by introducing the box tie through the elongated eyes 60 and rotating the box tie device vertically in plane 64. Upon insertion, the box tie device 42 is erectable in a horizontal plane (an xz plane) with the open end dimensioned for embedment in bed joint 28 of brick veneer 20. This relationship minimizes the x- and z-axis movement of the construct. Upon mounting the box tie device 42 in bed joint 28, the closed end 66 thereof is adjustably positionable along axes 62. For positive engagement, the elongated eyes 60 of eye wire portion 58 are sealed forming closed loops. The box tie 42 is a wire formative constructed with a rear or closed end portion 66, a pair of side portions 68 and 70, and a pair of substantially parallel front portions 72 and 74 with an opening or slot therebetween. The longitudinal axes of portions 66, 68, 70.72, and 74 are substantially coplanar. The opening formed between side portions 68 and 70 is slightly larger than the outer horizontal (viewed as installed) dimension of elongated eyes 60, and when the box tie 42 is threadedly emplaced through the eye opening, the spacing just described controls the x-axis movement of the construct. The substantially parallel front portions 72 and 74 are spaced apart sufficiently to engage the facing anchor 44 described hereinbelow. The front portion 72 is contiguous with side portion 68, and front portion 74 is contiguous with side portion 70. The facing anchor 44 is constructed from a reinforcement or straight wire member 76 and a clip member 78. The clip member 78 is an adaptation of the clip member described in U.S. Pat. No. 4,875,319, supra and, like the predecessor, is of unitary construction. The clip member 78 includes a base portion 80 and a plurality of substantially parallel projections 82, 84, 86, 88 and 90 defining a plurality of channels 92, 94, 96, and 98. The spacing between projections is proportioned in a manner such that the two innermost channels accept the front portions 72 and 74 of the box tie device 42. The spacing forming the two outermost channels are dimensioned such that one or more wire members 76 of preselected diameters may be selectively inserted in the appropriate channel. The bottom portion 100 of the clip member 78 has a plurality of parallel grooves 102. These grooves facilitate the bonding of the clip member 78 to the mortar in the bed joints 28 between courses of bricks 20. During the construction of the exterior wythe 18, the mortar also fills the channels of clip member 78 thereby bonding together the clip, the reinforcing wire and the box tie device 42.

Figure 4:
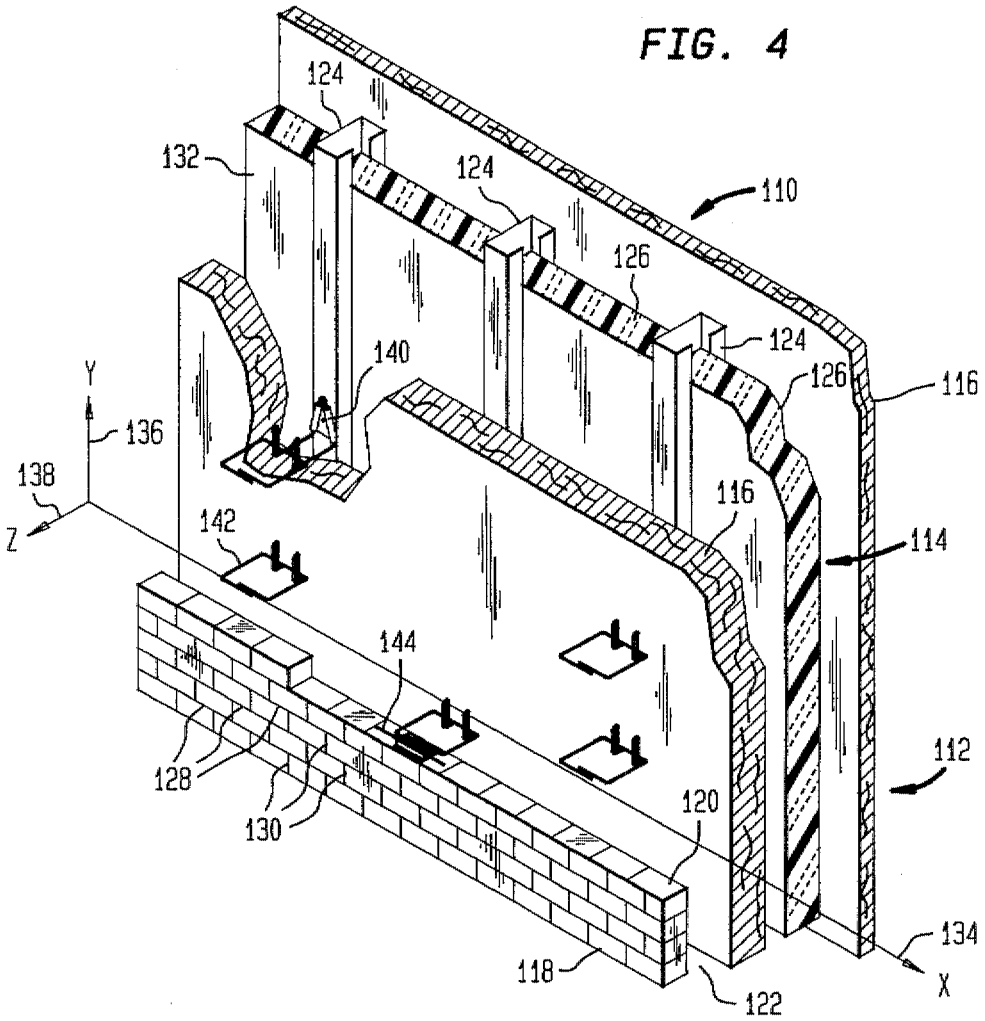
FIG. 4 is a perspective view of a second embodiment of a seismic construction system, including a surface-mounted veneer anchor, but shows a wall with an inner wythe of dry wall construction with metal studs and an outer wythe of brick veneer.
Figure 6:
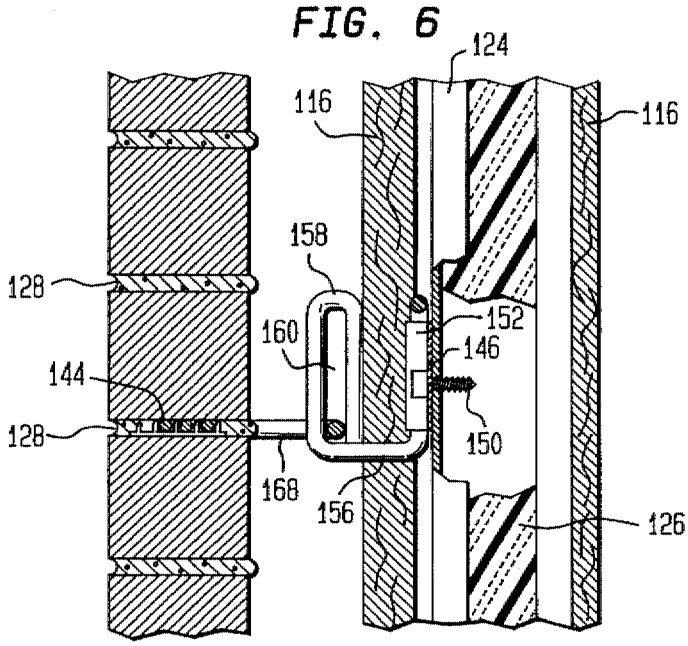
FIG. 6 is a cross-sectional view of the box tie and facing anchor of FIG. 5.
Figure 5:
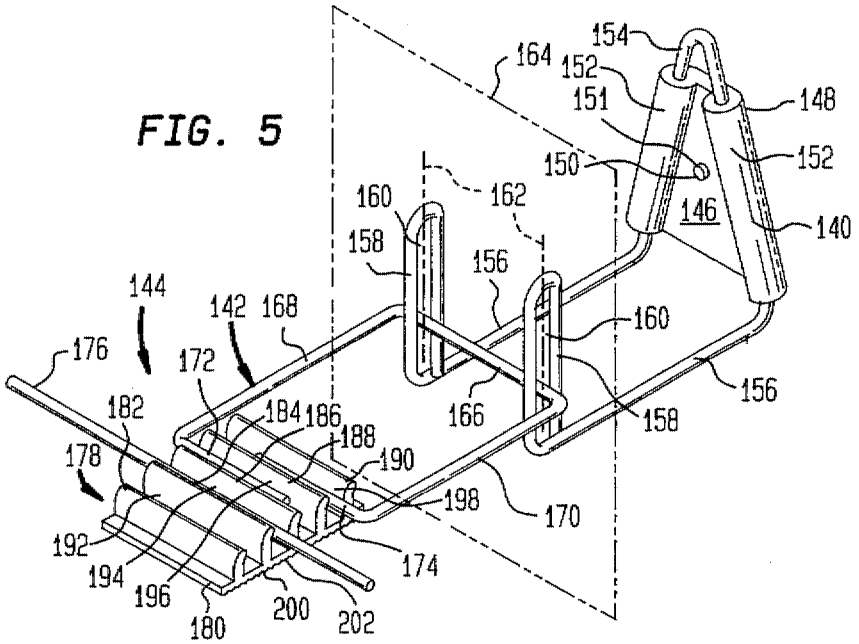
FIG. 5 is a partial perspective view of FIG. 4 showing details of the veneer anchor, the box tie, and the facing anchor.

The description which follows is of a second embodiment of the dry wall construction system utilizing the surface-mounted veneer anchor technology. For ease of comprehension, where similar parts are used reference designators "100" units higher are employed. Thus, the box tie 142 of the second embodiment is analogous to the box tie 42 of the first embodiment. Referring now to FIGS. 4 to 6, the second embodiment of a dry wall construction system of this invention is shown and is referred to generally by the numeral 110. In this embodiment, a dry wall structure 112 is shown having an interior wythe 114 of wallboard facings 116 and an exterior wythe 118 of facing brick 120. Between the interior wythe 114 and the exterior wythe 118, a cavity 122 is formed. In this embodiment, vertical metal studs 124 with insulating panels 126 therebetween are erected between the interior and exterior wallboard facings 116 and the metals studs 124 have substantially planar are vertically disposed outer surfaces. As in the first embodiment, successive bed joints 128 and 130 are formed between courses of bricks 120 and the joints are substantially planar and horizontally disposed. Sites at a vertical height on metal studs 124 corresponding to bed joint 128 are selected to be substantially coplanar, the one with the other. The extent of vertical misalignment that is tolerated by this system is discussed in greater detail hereinbelow. For purposes of discussion, the exterior surface 132 of the interior wythe 114 contains a horizontal line or x-axis 134 and an intersecting vertical line or y-axis 136. A horizontal line normal to the plane formed thereby or z-axis 138 also passes through the origin formed by the intersecting x- and y-axes. In the discussion which follows, it will be seen that the various anchor structures are constructed to restrict movement interfacially—wythe vs. wythe—along the z-axis and, in this embodiment, along the x-axis. The system 110 includes a surface-mounted veneer anchor 140 constructed for affixation to metal studs 124 and a box tie device 142 that is constructed to interlock with a facing anchor 144, both of which are for embedment in bed joint 128. The veneer anchor 140 is shown in FIGS. 5 and 6 as being affixed to a metal stud 124. In the best mode of practicing the invention, a sheetmetal plate or baseplate 146 is formed having a rear surface 148 which, when the baseplate 146 is mounted to the metal stud 124 by an attachment device 150, such as a self-tapping screw fastening device, inserted through aperture 151. The baseplate 146 is constructed with flanges 152 extending forwardly (when viewed as installed) from at least two sides thereof and being dimensioned to accommodate a wire formative 154 therewithin. In the second embodiment, the geometry of the baseplate 146 is distinguished from the generally rectangular baseplate 46, as shown for the first embodiment. Here, the baseplate is basically triangular with the flanges on adjacent sides rather than on opposite sides. A spaced pair of transverse wire member portions 156 are constructed to extend therefrom. These pairs of wire member portions 156 extend into the cavity 122. As will become clear by the description which follows, the spacing between wire member portions 156 limits the x-axis movement of the construct. Each transverse wire member portion 156 has at the end opposite the attachment end an elongated eye wire portion 158 formed continuous therewith. Upon installation, the eye 160 of eye wire portion 158 is constructed to be within a substantially vertical plane (a yz plane) normal to exterior surface 132 and the longitudinal axes 162 of eyes 160 to be within a substantially vertical plane 164 (an xy plane) parallel to exterior surface 132. The spatial relationship between the pair of elongated eyes 160 is constructed so that a box tie device 142 is threadedly emplaceable thereinto by introducing the box tie through the elongated eyes 160 and rotating the box tie device vertically in plane 164. Upon insertion the box tie device 142 is erectable in a horizontal plane (an xz plane) with the open end dimensioned for embedment in bed joint 130 of brick veneer 120. This relationship minimizes the x- and z-axis movement of the construct. For positive engagement, the elongated eyes 160 of eye wire portion 158 are sealed forming closed loops. The box tie 142 is a wire formative constructed with a rear portion 166, a pair of side portions 168 and 170, and a pair of substantially parallel front portions 172 and 174 with an opening or slot therebetween. The longitudinal axes of portions 166, 168, 170. 172; and 174 are substantially coplanar. The opening formed between side portions 168 and 170 is slightly larger than the outer horizontal (viewed as installed) dimension of a pair of elongated eyes 160, and when the box tie 142 is threadedly emplaced through the eye opening, the spacing just described controls the x-axis movement of the construct. The substantially parallel front portions 172 and 174 are spaced apart sufficiently to house therebetween reinforcement member 144. The front portion 172 is contiguous with side portion 168, and front portion 174 is contiguous with side portion 170. The facing anchor 144 is constructed from a reinforcement or straight wire member 176 and a clip member 178. The clip member 178 is an adaptation of the clip member described in U.S. Pat. No. 4,875,319, supra, and, like the predecessor, is of unitary construction. The clip member 178 includes a base portion 180 and a plurality of substantially parallel projections 182, 184, 186, 188, and 190 defining a plurality of channels 192, 194, 196, and 198. The spacing between projections is proportioned in a manner such that the two innermost channels accept the front portions 172 and 174 of the box tie device 142. The spacing forming the two outermost channels are dimensioned such that one or more straight wire members 176 of preselected diameters may be selectively inserted in the appropriate channel. The bottom portion 200 of the clip member 178 has a plurality of parallel grooves 202. These grooves facilitate the bonding of the clip member 178 to the mortar in the bed joints 28 between courses of bricks 120. During the construction of the exterior wythe 118, the mortar also fills the channels of clip member 178 thereby bonding together the clip, the reinforcing wire and the box tie device 142.

Figure 7:
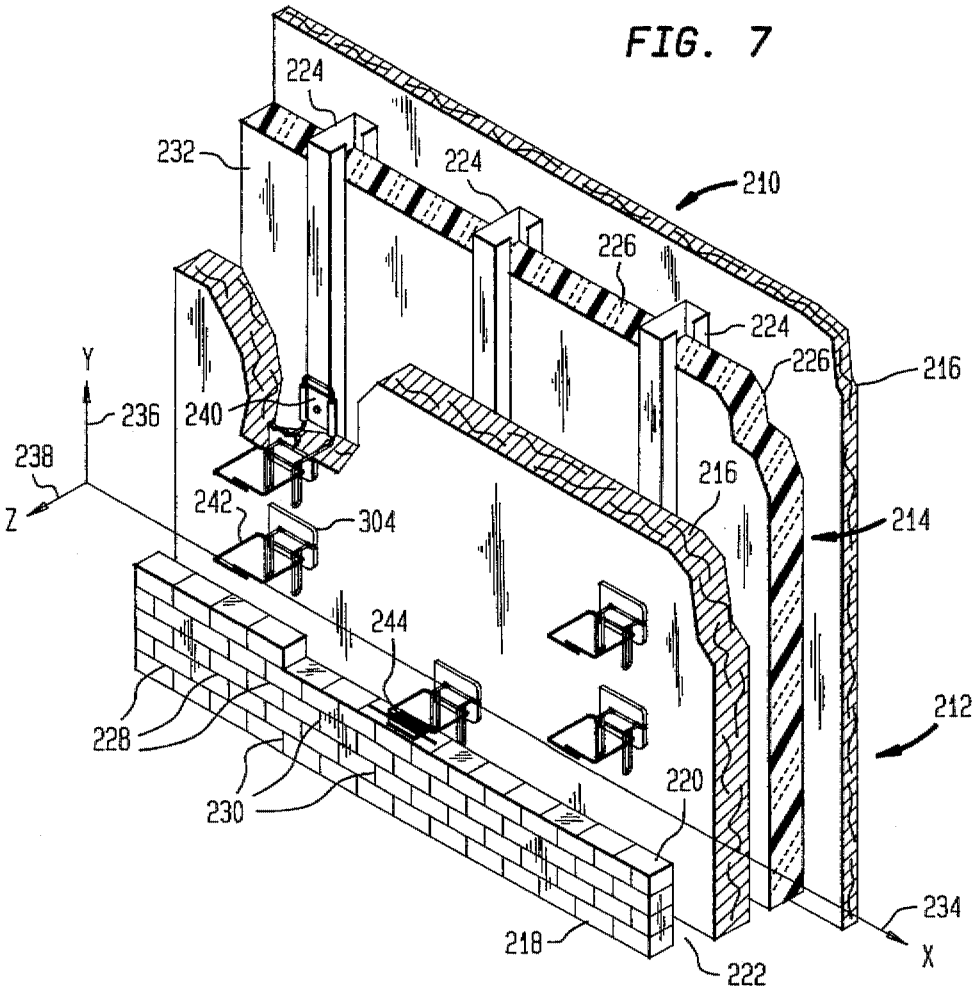
FIG. 7 is a perspective view of a third embodiment of a seismic construction system, including a surface-mounted veneer anchor similar to FIG. 4, but showing a wall with an inner wythe having externally mounted insulation.
Figure 8:
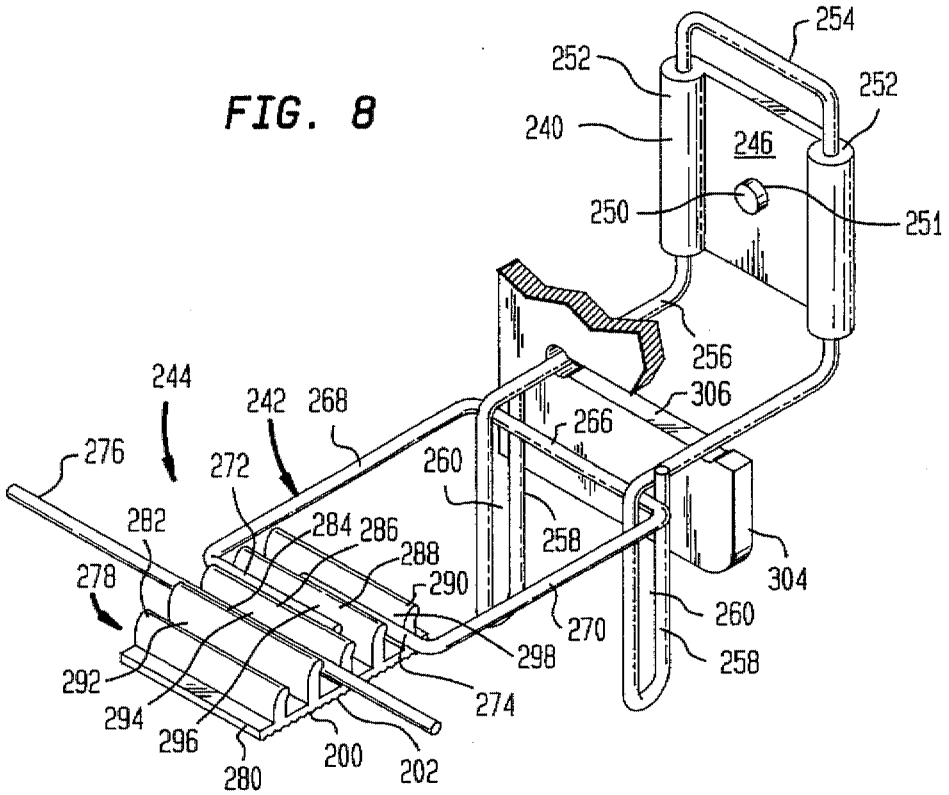
FIG. 8 is a partial perspective view of FIG. 7 showing details of the veneer anchor, the box tie, and the facing anchor; and, FIG. 9 is a cross-sectional view of the box tie and the facing anchor of FIG. 8.
Figure 9:
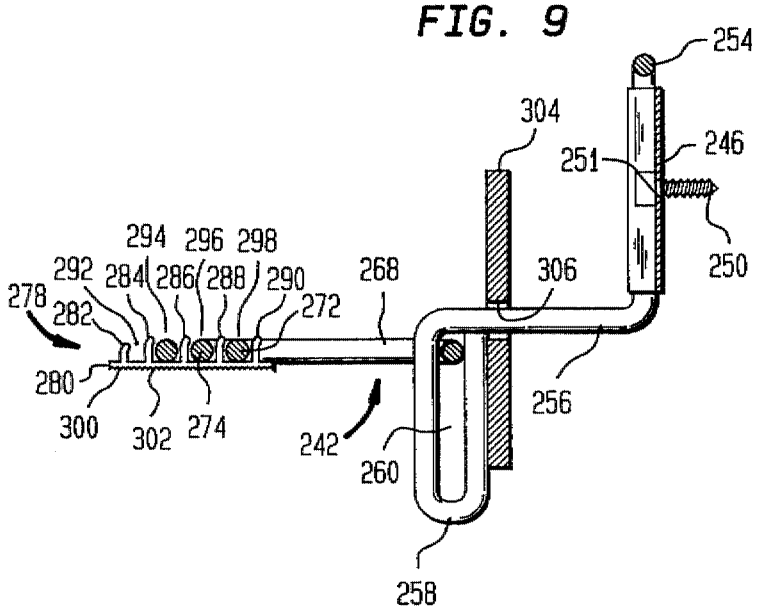

Referring now to FIGS. 7 to 9, the third embodiment of the masonry construction system is shown and is referred to generally by the numeral 210. The dry wall structure 212 is shown having an interior wythe 214 with wallboards 216 as the interior and exterior facings thereof. An exterior wythe 218 of facing brick 220 is attached to dry wall structure 212 and a cavity 222 is formed therebetween. The dry wall structure 212 is constructed to include, besides the wallboard facings 216, vertical studs or channels 224, insulation layer 226 disposed on the exterior face of exterior wallboard 216. The insulation layer 226 is commonly applied in horizontal strips having horizontal seams 227 between abutting strips. Selected bed joints 228 and 230 are constructed to be in cooperative functional relationship with the surface-mounted veneer anchor described in more detail below. For purposes of discussion, the exterior surface 232 of the interior wythe 214 contains a horizontal line or x-axis 234 and an intersecting vertical line or y-axis 236. A horizontal line normal to the plane formed thereby or z-axis 238 also passes through the origin formed by the intersecting x- and y-axes. The system 210 includes a surface-mounted veneer anchor 240 constructed for attachment to vertical channel members or metal studs 224, a facing anchor 242 constructed for embedment in joint 228 and an interconnecting wall tie member 244. These components 240, 242, and 244 are shown in FIGS. 8 and 9 and are interconnected with one another and affixed to a metal stud 224. In the best mode of practicing the invention, a sheetmetal plate or baseplate 246 is formed having a rear surface 248 which, when the baseplate 246 is mounted to the metal stud 224 by an attachment device 250, such as a self-tapping screw fastening device, inserted through aperture 251. The baseplate 246 is constructed with flanges 252 extending forwardly (when viewed as installed) from at least two sides thereof and being dimensioned to accommodate a wire formative 254 therewithin. In this embodiment, the geometry of the baseplate 246 is similar to that of generally rectangular baseplate 46, as shown for the first embodiment. A spaced pair of transverse wire member portions 256 are constructed to extend therefrom. These pairs of wire member portions 256 extend over the insulation 226 into the cavity 222. As will become clear by the description which follows, the spacing between wire member portions 256 limits the x-axis movement of the construct. Each transverse wire member portion 256 has at the end opposite the attachment end an elongated eye wire portion 258 formed continuous therewith. With the externally applied horizontal strip-type insulation, the eye wire portions 258 are constructed to depend, when installed, downwardly from the transverse wire portion 256 and together with insulation shield 259 hold the insulation 226 in place. Upon installation, the eye 260 of eye wire portion 258 is constructed to be within a substantially vertical plane (a yz plane) normal to exterior surface 232 and the longitudinal axes 262 of eyes 260 to be within a substantially vertical plane 264 (an xy plane) parallel to exterior surface 232. The spatial relationship between the pair of elongated eyes 260 is constructed so that a box tie device 242 is threadedly emplaceable thereinto by introducing the box tie through the elongated eyes 260 and rotating the box tie device vertically in plane 264. Upon insertion the box tie device 242 is erectable in a horizontal plane (an xz plane) with the open end dimensioned for embedment in bed joint 230 of brick veneer 220. This relationship minimizes the x-and z-axis movement of the construct. For positive engagement, the elongated eyes 260 of eye wire portion 258 are sealed forming closed loops. The box tie 242 is a wire formative constructed with a rear portion 266, a pair of side portions 268 and 270, and a pair of substantially parallel front portions 272 and 274. The longitudinal axes of portions 266, 268, 270. 272, and 274 are substantially coplanar. The opening formed between side portions 268 and 270 is slightly larger than the outer horizontal (viewed as installed) dimension of a pair of elongated eyes 260, and when the box tie 242 is threadedly emplaced through the eye opening, the spacing just described controls the x-axis movement of the construct. The substantially parallel front portions 272 and 274 are spaced apart sufficiently to house therebetween reinforcement member 244. The front portion 272 is contiguous with side portion 268, and front portion 274 is contiguous with side portion 270. The facing anchor 244 is constructed from a reinforcement or straight wire member 276 and a clip member 278. The clip member 278 is an adaptation of the clip member described in U.S. Pat. No. 4,875,319, supra, and, like the predecessor, is of unitary construction. The clip member 278 includes a base portion 280 and a plurality of substantially parallel projections 282, 284, 286, 288, and 290 defining a plurality of channels 292, 294, 296 and 298. The spacing between projections is proportioned in a manner such that the two innermost channels accept the front portions 272 and 274 of the box tie device 242. The spacing forming the two outermost channels are dimensioned such that one or more straight wire member 276 of preselected diameters may be selectively inserted in the appropriate channel. The bottom portion 300 of the clip member 278 has a plurality of parallel grooves 302. These grooves facilitate the bonding of the clip member 278 to the mortar in the bed joints 228 between courses of bricks 220. During the construction of the exterior wythe 218, the mortar also fills the channels of clip member 278 thereby bonding together the clip, the reinforcing wire and the box tie device. In the drawings, an optional insulation retaining plate 304 is shown, and is constructed to fit over a pair of transverse wire members 256 with the channel 306 securing the plate in position. The plate 304 fits against the rear portion of elongated eyes 260 of eye wire portions 258 and spreads the force of the eye wire portions 258 over the area of the plate. The deformation of the insulation pieces along the edge retained by the eye wire is thereby minimized.

Although the foregoing description suggests planar box ties 42, 142 and 242, it is within the contemplation of the present invention that a bent box tie is applicable. Also, although all of the box ties are rectangular, other geometric shapes could function satisfactorily. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A seismic construction system for use in the construction of a wall structure having an inner wythe having an outer surface and an outer wythe of a facing material in spaced apart relationship forming a cavity therebetween, said system comprising, in combination:

a veneer anchor mountable on said outer surface of said inner wythe, in turn, comprising:

a baseplate substantially planar in form;

a spaced pair of transverse wire portions attached to and extending from said baseplate, each transverse wire portion attached at one end thereof to said baseplate and, when the baseplate is secured to said inner wythe, each of said pair of transverse wire portions extending into said cavity and terminating therewithin; and, a pair of elongated eye wire portions formed continuous with each said transverse wire portion and attached thereto at the end opposite the attachment end, said elongated eye wire portion forming an eye adapted, when installed in said wall structure, to be disposed in said cavity and to lie in a plane normal to the inner wythe surface;

a box tie device having a closed first end portion and an open second end portion, said first end portion being captively disposed in one pair of said eye wire portions; and, a facing anchor adapted to be embedded within said outer facing wythe;

whereby, upon surface mounting of said veneer anchor on said inner wythe, captively disposing the closed end of the box tie device in the eye wire portion thereof, and the embedding the open end of said box tie device secured to the facing anchor and the facing anchor in the outer wythe; a seismic construct is formed.

2. A seismic construction system as described in claim 1 wherein said facing anchor comprises:

a clip member having a base member, said base member including:

first and second attachment means formed thereon, said second end portion of said box tie member being secured to said first attachment means of said clip member;

at least one reinforcement wire portion disposed longitudinally in said facing wythe and secured to said second attachment means of said clip member.

3. A seismic construction system in claim 1 wherein said baseplate further comprises a pair of rolled flanges, each rolled flange at an edge of said baseplate and said pair of rolled flanges being rolled atop one surface of said baseplate, and each said rolled flange holding therewithin a portion of said wire formative.

4. A seismic construction system as described in claim 3 further comprising:

a wire formative including said transverse wire portion and said elongated eye wire portions;

a mounting wire portion formed continuous with both said transverse wire portions and interconnecting said transverse wire portions at the attachment ends thereof; and, said mounting wire portion, when assembled to said baseplate, disposed within said rolled flanges.

5. A seismic construction system as described in claim 4 wherein said mounting wire portion is U-shaped, said baseplate is substantially rectangular, and the rolled flanges are on opposite sides thereof.

6. A seismic construction system as described in claim 4 wherein said mounting wire portion is V-shaped, said baseplate is substantially triangular and the rolled flanges are on adjacent legs thereof.

7. A seismic construction system as described in claim 4 wherein said elongated eye wire portion is sealed by affixing the end thereof opposite the end attached to the transverse wire portion to a medial part of the eye wire portion and thereby forming a closed loop.

8. A seismic construction system as described in claim 7 wherein said box tie device is a planar body threadably insertable through said pair of elongated eye wire portions and dimensioned to operate when embedded in said outer wythe, with minimal side-to-side endplay.

9. A seismic construction system as described in claim 8 wherein a horizontal line within the surface plane of the inner wythe defines the x-axis, an intersecting vertical line within the surface plane of the inner wythe defines the y-axis, and a line normal thereto and passing through the intersection defines the z-axis, said wall structure having substantially no x-axis and substantially no z-axis movement of the inner wythe with respect to the outer wythe.

10. A seismic construction system for use in a wall structure having an inner wythe of dry wall construction with supporting vertical metal studs and an outer wythe of a brick facing, said wythes in spaced apart relationship forming a cavity between the outer surface of said inner wythe and the inner surface of said outer facing wythe, said system comprising, in combination:

a baseplate substantially planar in form for mounting to the outer surface of said inner wythe; and, a pair of rolled flanges, each rolled flange at an edge of said baseplate and said pair of rolled flanges being rolled atop one surface of said baseplate;

a wire formative attached by each of said rolled flanges holding therewithin a portion of said wire formative, said wire formative, in turn, comprising:

a spaced pair of transverse wire portions extending from said baseplate, each transverse wire portion attached at one end thereof to said baseplane and, when the baseplate is secured to said inner wythe, each of said pair of transverse wire portions extends into said cavity and terminates therewithin; and, a pair of elongated eye wire portions formed continuous with each said transverse wire portion and attached thereto at the end opposite the attachment end, said elongated eye wire portion forming an eye adapted, when installed in said wall structure, to be disposed in said cavity and to lie in a plane normal to the inner wythe surface;

a mounting wire portion formed continuous with both said transverse wire portions and interconnecting said traverse wire portions at the attachment ends thereof, and said mounting wire portion, when assembled to said baseplate, disposed within said rolled flanges;

aperture means in said baseplate for housing a fastener therein;

attachment means for attaching said baseplate to said metal stud, said attachment means threadingly engaging said metal stud;

a box tie device having a closed first end portion and an open second end portion, said first end portion being captively disposed in one pair of said eye wire portions; and, a facing anchor adapted to be embedded within said outer facing wythe;

whereby, upon surface mounting of said veneer anchor on said inner wythe, captively disposing the closed end of the box tie device in the eye wire portion thereof, and the embedding the open end of said box tie device secured to the facing anchor and the facing anchor in the outer wythe; a seismic construct is formed.

11. A seismic construction system as described in claim 10 wherein with the veneer anchor surface mounted on said inner wythe and with the said outer facing wythe formed from successive courses of bricks, said wall tie further comprises:

a pair of side portions extending transverse the longitudinal aspect of said outer wythe; and, a rear portion joining said side portions, said rear portion together with said side portions dimensioned to fit snugly about the pair of elongated eye portions of said veneer anchor.

12. A seismic construction system as described in claim 10 wherein said outer facing wythe is formed from successive courses of bricks, said veneer anchoring system further comprises:

said box tie, in turn, further comprising;

reinforcement wire capturing means for encapturing therewithin a reinforcement wire longitudinally disposed on said outer facing wythe, said capturing means in said pair of leg portions dimensioned to accommodate a wire reinforcement in a nesting fashion;

at least one reinforcement wire portion disposed longitudinally in said outer facing wythe and adapted to nest within said second end portion of said wall tie member.

13. A seismic construction system as described in claim 10 herein said elongated eye wire portion is sealed by affixing the end thereof opposite the end attached to the transverse wire portion to a medial part of the eye wire portion and thereby forming a closed loop.

14. A seismic construction system as described in claim 13 wherein said box tie device is a planar body threadably insertable through said pair of elongated eye wire portions and dimensioned to operate when embedded in said outer wythe, with minimal side-to-side endplay.

15. A seismic construction system as described in claim 8 wherein a horizontal line within the surface plane of the inner wythe defines the x-axis, an intersecting vertical line within the surface plane of the inner wythe defines the y-axis, and a line normal thereto and passing through the intersection defines the z-axis, said wall structure having substantially no x-axis and substantially no z-axis movement of the inner wythe with respect to the outer wythe.

16. A seismic construction system for use in the construction of a wall structure having an inner wythe having an outer surface and an outer wythe of a facing material in spaced apart relationship forming a cavity therebetween, said system comprising, in combination:

a veneer anchor mountable on said outer surface of said inner wythe, in turn, comprising:

a baseplate substantially planar in form;

a spaced pair of transverse wire portions attached to and extending from said baseplate, each transverse wire portion attached at one end thereof to said baseplate and, when the baseplate is secured to said inner wythe, each of said pair of transverse wire portions extending into said cavity and terminating therewithin; and, a pair of elongated eye wire portions formed continuous with each said transverse wire portion and attached thereto at the end opposite the attachment end, said elongated eye wire portion forming an eye adapted, when installed in said wall structure, to be disposed in said cavity and to lie in a plane normal to the inner wythe surface;

a box tie device having a closed first end portion and an open second end portion, said first end portion being captively disposed in one pair of said eye wire portions; and, a facing anchor adapted to be embedded within said outer facing wythe, said facing anchor, in turn, comprising:

a clip member comprising having a base member, said base member including:

first and second attachment means formed thereon, said second end portion of said box tie member being secured to said first attachment means of said clip member;

at least one reinforcement wire portion disposed longitudinally in said facing wythe and secured to said second attachment means of said clip member;

whereby, upon surface mounting of said veneer anchor on said inner wythe, captively disposing the closed end of the box tie device in the eye wire portion thereof, and the embedding the open end of said box tie device secured to the facing anchor and the facing anchor in the outer wythe; a seismic construct is formed.

17. A seismic construction system as described in claim 16 further comprising:

a wire formative including said transverse wire portion and said elongated eye wire portions;

a mounting wire portion formed continuous with both said transverse wire portions and interconnecting said transverse wire portions at the attachment ends thereof; and, said mounting wire portion, when assembled to said baseplate, disposed within said rolled flanges.

18. A seismic construction system as described in claim 17 wherein said elongated eye wire portion is sealed by affixing the end thereof opposite the end attached to the transverse wire portion to a medial part of the eye wire portion and thereby forming a closed loop.

19. A seismic construction system as described in claim 18 wherein said box tie device is a planar body threadably insertable through said pair of elongated eye wire portions and dimensioned to operate when embedded in said outer wythe, with minimal side-to-side endplay.

20. A seismic construction system as described in claim 19 wherein a horizontal line within the surface plane of the inner wythe defines the x-axis, an intersecting vertical line within the surface plane of the inner wythe defines the y-axis, and a line normal thereto and passing through the intersection defines the z-axis, said wall structure having substantially no x-axis and substantially no z-axis movement of the inner wythe with respect to the outer wythe.

* * * * *